US006667109B1

(12) United States Patent
Julliard

(10) Patent No.: US 6,667,109 B1
(45) Date of Patent: Dec. 23, 2003

(54) TWO-PIECE DECORATIVE MEDALLION

(75) Inventor: Kent T. Julliard, Stryker, OH (US)

(73) Assignee: Style Solutions, Incorporated, Archbold, OH (US)

( * ) Notice: Subject to any disclaimer, the term of this patent is extended or adjusted under 35 U.S.C. 154(b) by 0 days.

(21) Appl. No.: 10/252,890

(22) Filed: Sep. 23, 2002

(51) Int. Cl.[7] ..... F21V 21/02; B25G 3/00

(52) U.S. Cl. ..... 428/542.2; 428/542.6; 428/3; 428/4; 362/457; 362/806; 362/145; 362/147; 52/316; 52/392; 52/592.1

(58) Field of Search ..... 428/542.2, 3, 4, 428/542.6; 40/1.5; 403/345, 354; 292/256.6; D26/24; 362/457, 806, 145, 147; 52/316, 392, 592.1

(56) References Cited

U.S. PATENT DOCUMENTS

| | | | | | |
|---|---|---|---|---|---|
| 2,196,214 | A | * | 4/1940 | Kantack | 362/235 |
| 3,115,958 | A | * | 12/1963 | Sabel | 52/663 |
| 3,698,565 | A | * | 10/1972 | Weber | 211/87.01 |
| 3,819,458 | A | * | 6/1974 | Kinderman et al. | 428/10 |
| 4,465,740 | A | * | 8/1984 | Diamond et al. | 428/542.2 |
| 4,844,487 | A | * | 7/1989 | Eakin | 277/497 |
| 5,185,908 | A | * | 2/1993 | Oetiker | 24/20 R |
| 5,577,728 | A | * | 11/1996 | Kondo | 273/157 A |
| 5,586,832 | A | * | 12/1996 | Zylka | 403/344 |
| 5,685,116 | A | * | 11/1997 | Bradshaw et al. | 52/311.1 |
| 6,481,061 | B1 | * | 11/2002 | Andre et al. | 24/20 R |

FOREIGN PATENT DOCUMENTS

| | | | | |
|---|---|---|---|---|
| SU | SE 8202545 | * | 12/1983 | F21V/21/02 |

* cited by examiner

*Primary Examiner*—Cathy Lam
*Assistant Examiner*—Vivek Koppikar
(74) *Attorney, Agent, or Firm*—Cesari and McKenna, LLP

(57) ABSTRACT

A decorative medallion consists of two pieces that may be assembled about a mounted fixture. The medallion pieces are decorated with surface ornamentation to add to their visual appeal. A first piece of the medallion includes at a first end an overlapping member whose outline follows prominent features in the surface ornamentation, and at a second end an underledge designed to receive the overlapping member of the second piece. The second piece similarly includes an underledge that is designed to receive the overlapping member of the first piece. The respective overlapping members have recessed edges that are shaped to include one or more alignment features, such as protrusions and concave receiving portions. The underledges are shaped to slideably mate with the corresponding alignment features of the respective overlapping members, and thus, include various corresponding concave receiving portions and protrusions. The alignment features allow the two pieces to slide relative to one another into both lateral and vertical alignment, and the respective outlines of the top surfaces of the overlapping members essentially hide the seams in the surface ornamentation.

18 Claims, 5 Drawing Sheets

TWO-PIECE DECORATIVE MEDALLION

BACKGROUND OF THE INVENTION

1. Field of the Invention

The present invention relates to decorative moldings for interior use, and in particular, to a decorative medallion for use with a ceiling fixture.

2. Background Information

Traditionally, a ceiling medallion is a decorative disk that is used to accent or enhance the appearance of a ceiling fixture, such as a light fixture or ceiling fan. The medallions also are generally decorated with surface ornamentation, such as raised "carvings" or relief work, to add to the visual appeal. The medallions are on the order of an inch or two in thickness, and may be between several inches to a few feet in diameter, with the size depending largely on the size of the associated fixture and/or the corresponding expanse of the ceiling. Generally, the main consideration in medallion size and thickness is aesthetics.

Medallions are usually constructed of a rigid material that is suited to showing surface detail and ornamentation. Historically, medallions were constructed mainly of solid wood, plaster, or a combination of the two. More recently, bonded wood products, such as medium density fiber board (MDF), and Architectural Foam products, have become popular construction materials since they are relatively easy to work with and are less lighter in weight and are less expensive than other materials. The advent of these newer materials has prompted construction of medallions in shapes and designs that previously would have been prohibitively expensive.

The installation of a medallion in a new construction is a relatively easy and inexpensive task, since the medallion is installed prior to the mounting and electrical connection of the associated fixture. The installation is not so simple or economical, however, when retro-fitting or remodeling an existing construction.

If a known prior medallion is used in remodeling, the fixture must first be electrically disconnected and then removed from the ceiling. Thus, the electrical power to the fixture must be turned off, the fixture's mounting hardware carefully loosened and the fixture detached and disconnected. Often detaching a fixture can be difficult, with some fixtures being very delicate and/or awkward to handle. Further, some older fixtures may be secured in unusual ways and/or may have paint-filled or rounded-over screw heads that make the fasteners hard to undo. Once the fixture is detached, the electrical wiring to the fixture is disconnected, which as discussed below is not necessarily an easy task. The fixture must then be stored in a safe place while the medallion is installed. Thereafter, the fixture must again be electrically connected and remounted, and finally, the power can be restored. The overall installation process is thus rather time consuming.

Most homeowners will have to hire a professional electrician to handle the electrical aspects of the installation. For the average homeowner, even a small electrical task may be troubling, and potentially unsafe, especially if the older wiring is in place in. Older wiring, for example, often does not meet current building codes and may pose dangers due to lack of proper grounding and lack of ground fault interruption (GFI) switches. Even properly grounded wiring may be dangerous if the insulation has become brittle and cracked over time. While the safest course is for the homeowner to hire an electrician to remove and remount the fixture, it greatly increases the cost of the task.

There is thus a need for a medallion that can be installed without the removal of an existing fixture. Yet, such a medallion must retain the appearance and aesthetic appeal of known prior medallions to be accepted.

SUMMARY OF THE INVENTION

The present invention is a two-piece decorative medallion that may be installed around a mounted fixture. The medallion consists of two pieces that, when assembled, include surface ornamentation that continues, seemingly without interruption, across the pieces. To install the medallion, an installer places the two pieces on either side of the fixture and slides the two pieces into alignment, using integral alignment features that ensure both vertical and lateral alignment.

More specifically, each piece of the medallion includes at one end an overlapping member and at a second end an underledge. The overlapping member of a first piece is cut in an outline that corresponds to a feature of the surface ornamentation, and includes the surface ornamentation pattern on a top surface. Below the surface, the overlapping member includes a recessed edge that is shaped to include one or more alignment features, such as protrusions and concave receiving portions. The underledge of the second piece is cut with an edge that mates with the recessed edge of the overlapping member of the first piece. The edge of underledge thus includes protrusions that fit within corresponding concave receiving portions, and concave portions that receive corresponding protrusions. The various protrusions and the corresponding concave portions are designed to slidably mate, to ensure that the two medallion pieces properly align during installation. When the two pieces are so aligned, the seams between them are essentially hidden by the surface ornamentation.

The current medallion may be installed without the removal of a fixture, and thus, without the services of an electrician. Accordingly, the installation process is simpler, faster and less expensive than the process of installing the known prior medallions.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
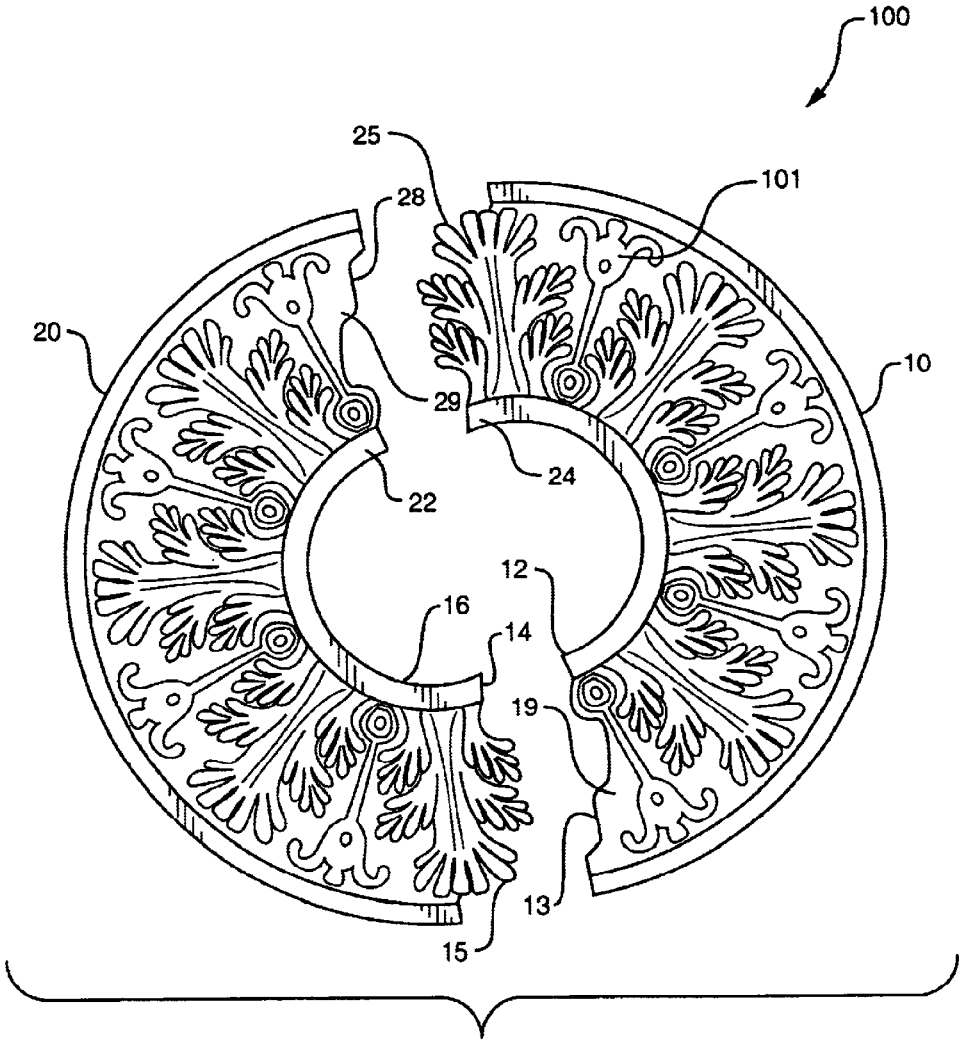
FIG. 1 depicts a front view of a two-piece medallion with the pieces separated by a small space.
Figure 4:
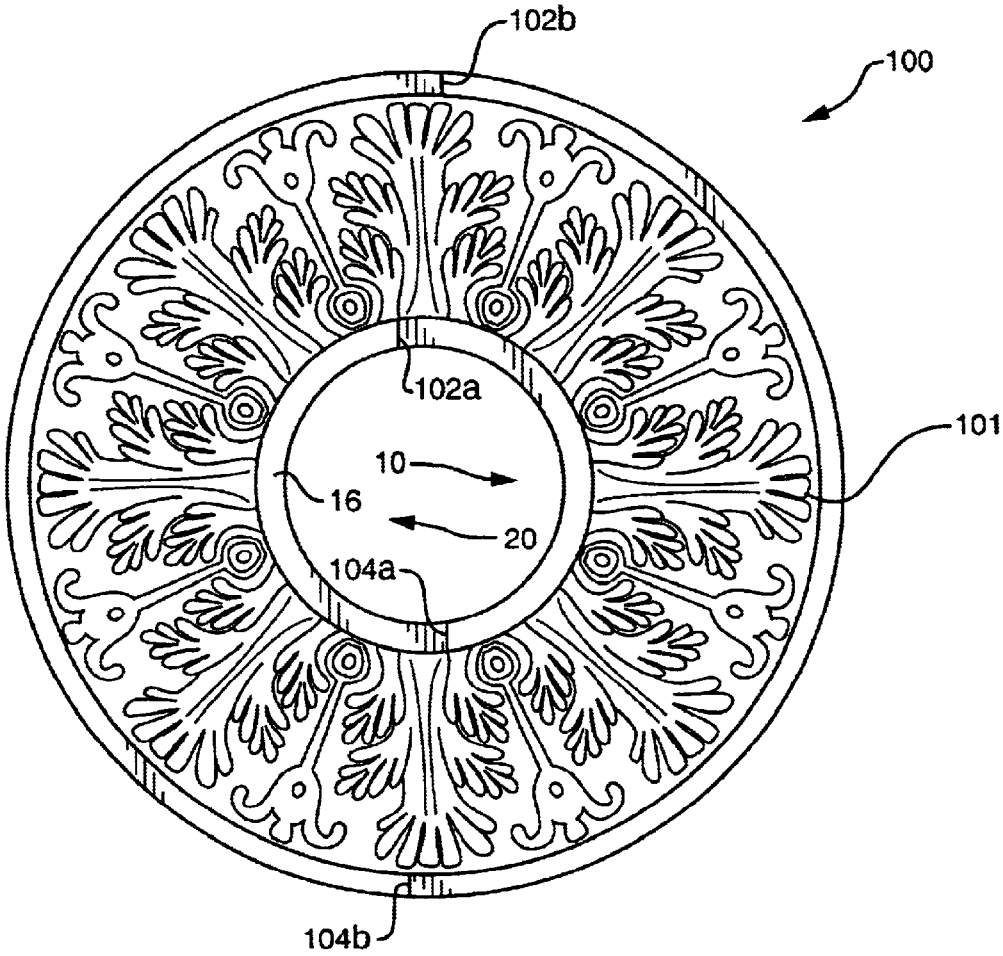
FIG. 4 depicts a front view of the medallion of FIG. 1 with the two pieces joined; and, FIG. 5 depicts an enlarged view of joining ends of the two pieces of the medallion of FIG. 1.
Figure 5:
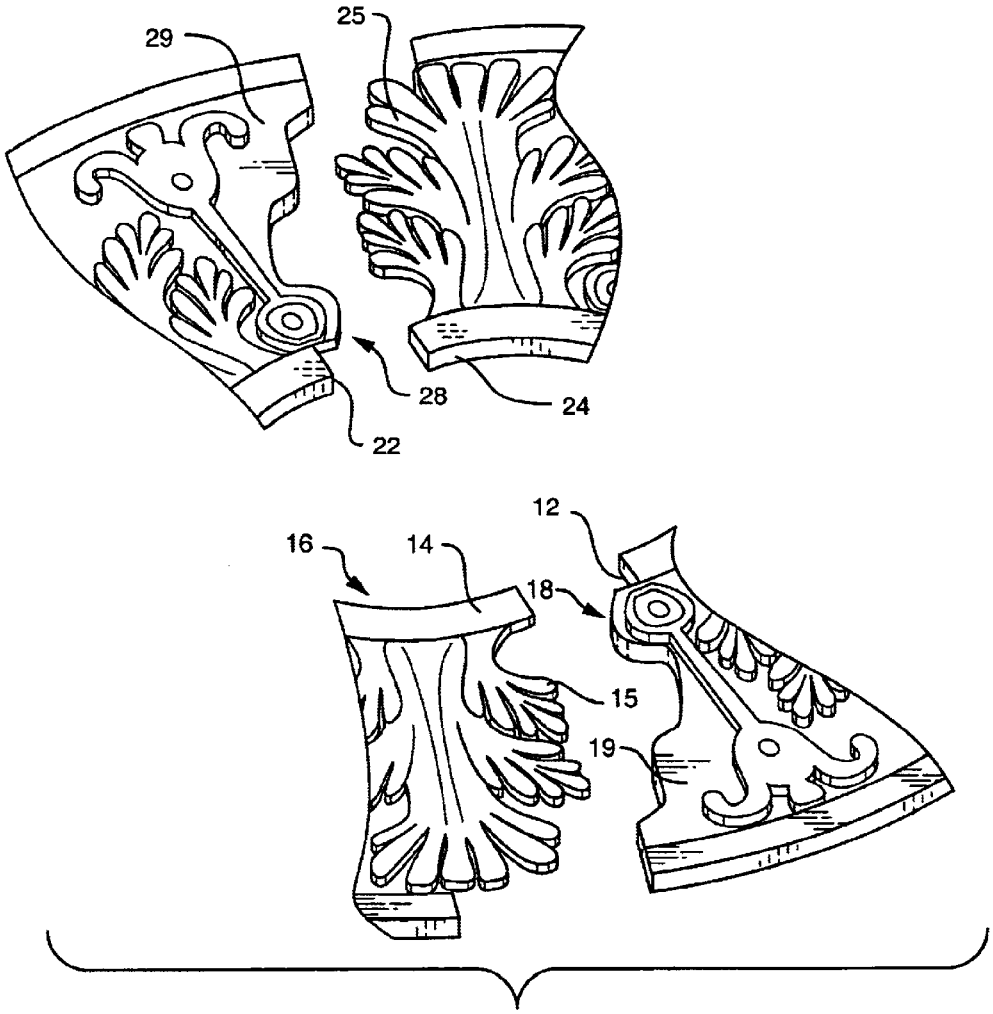

FIG. 1 depicts a front view of two pieces 10 and 20 which, when combined, constitute a ceiling medallion 100. FIG. 4 depicts the assembled medallion. The pieces 10 and 20 may be constructed out of any type of rigid material that can be cut, sculpted or molded into decorative designs, such as solid wood, plaster, a bonded wood product such as Medium Density Fiberboard (MDF), or Architectural Foam which due to its ease of manufacture and relatively light weight is generally preferred.

Referring again to FIG. 1, the pieces 10 and 20 are preferably decorated with surface ornamentation 101 or other relief work, to add to the visual appeal. The ornamentation is also employed as part of a novel method of joining the two medallion pieces, which include at either end, overlapping members 15 and 25 and underledges 18 and 28, respectively. Each overlapping member 15 and 25 is cut in an outline that follows the surface ornamentation of the medallion. The outline follows one or more prominent features, raised portions, or other attributes of the surface ornamentation, and preferably follows natural shadow lines of the surface ornamentation. Extra sections 14 and 24, which are parts of an inner rim 16, are cut such that they extend outwardly.

The underledges 18 and 28 are regions of the medallion pieces that are formed to receive the overlapping members 15 and 25. The underledges 18 and 28, which include top surfaces 19 and 29 that are essentially devoid of ornamentation, are designed to extend a short distance under the top surfaces of the overlapping members 15 and 25. The respective top surfaces 19 and 29 thus form backgrounds that are visible between cut-out portions of the outlines of the overlapping members, when the two pieces 10 and 20 are joined. Further, the top surfaces 19 and 29 provide convenient areas in which to apply adhesive, to hold the two medallion pieces together.

The underledges have rim ends 12 and 22 that are undercut, to receive the extending rim ends 14 and 24 of the corresponding overlapping members 15 and 25. The underledges 18 and 28 thus aid in aligning the medallion pieces with respect to one another. The overlap of members 15 and 25 with underledges 18 and 28, and in particular the mating of extending sections 14 and 24 with undercut sections 12 and 22 promote alignment of the two pieces 10 and 20, as does the actual overlapping of the joining ends of the two pieces. If the medallion pieces did not have the underledges and overlapping members, and instead simply met one another, it would be difficult for an installer to align the pieces accurately, particularly on an uneven ceiling.

Figure 2:
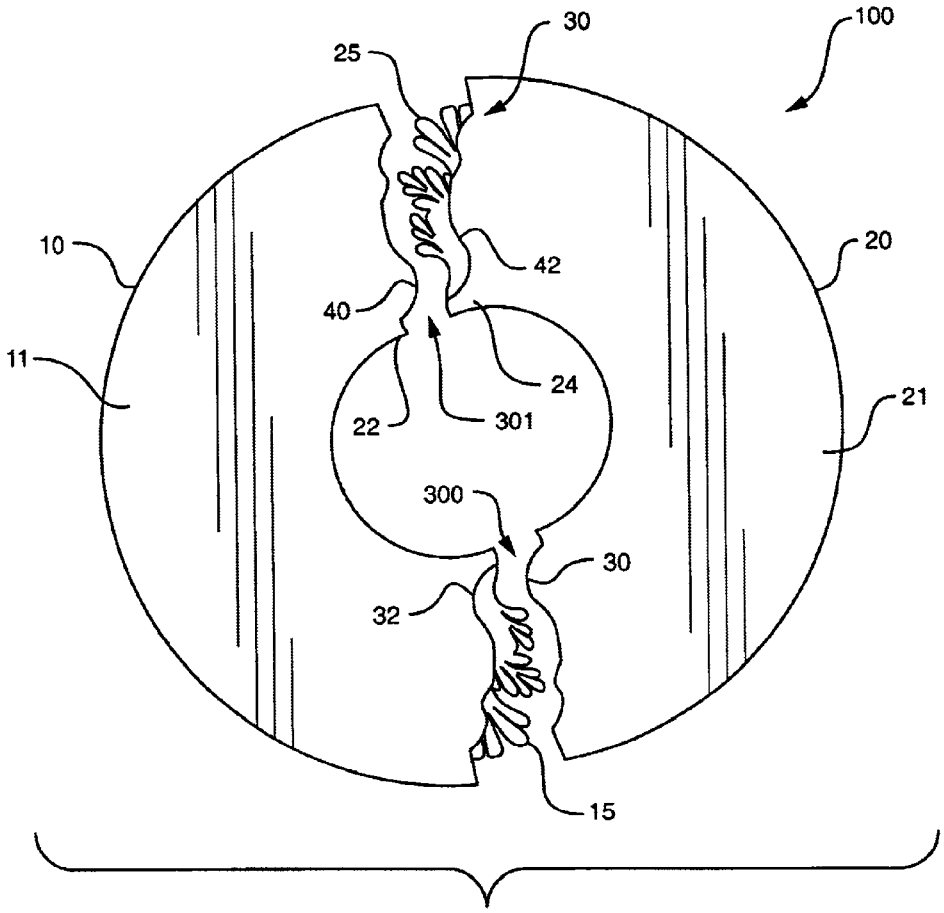
FIG. 2 depicts a rear view of the medallion of FIG. 1.

FIG. 2 is rear view of the medallion 100, depicting the undersides 11 and 21 of the medallion. Aside from a recessed edge 30, which is discussed in more detail with reference to FIG. 3, the undersides are preferably flat, to allow a large surface area in which to apply adhesive or attach fasteners. Alternately, the underside of the medallion may have recesses or hollowed sections (not shown), to save material in the manufacturing process and/or reduce the weight of the medallion.

Figure 3:
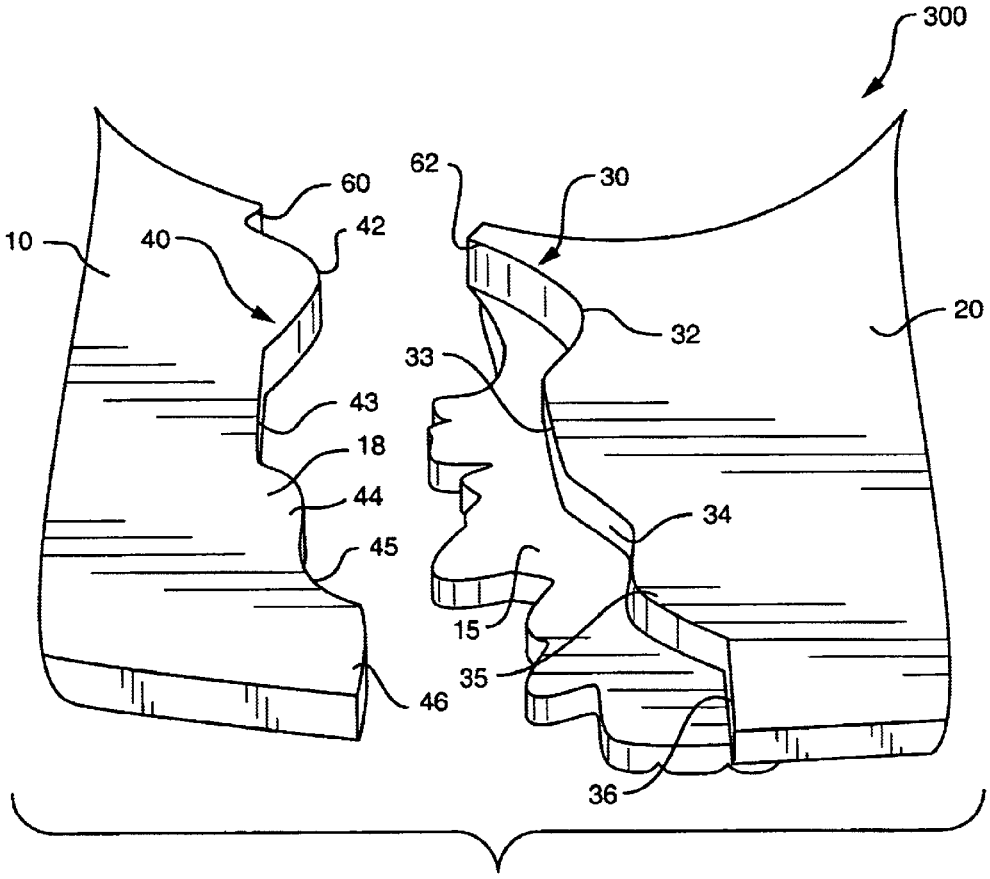
FIG. 3 depicts an enlarged view of a joining region depicted in FIG. 2.

FIG. 3 is an enlarged rear view of one set of joining ends of the two pieces 10 and 20, namely, the overlapping member 15 and the corresponding underledge 18. As discussed, the top surface of the overlapping member 15 has an outline that follows prominent features of the surface ornamentation 101. The overlapping member further includes the recessed edge 30, which is shaped to include one or more alignment features 32–36. The outer edge 40 of the underledge 18 is shaped to include alignment features 42–46 that mate with the corresponding features of the recessed edge 30. The alignment features essentially direct the two pieces 10 and 20 into full alignment, as the outside edge 40 of the underledge slides relative to the recessed edge 30 of the overlapping member another until the corresponding alignment features mate. For example, the protrusion 42 slides along and into the concave portion 32, while the protrusion 35 slides along and into concave portion 45, and so forth.

FIG. 4 is a front view of the assembled medallion 100, depicting the pieces as they look when fully assembled. The overlapping members 15 and 25 mate with underledges 18 and 28, such that the surface ornamentation 101 essentially continues from one piece to the other, with similar spacing and arrangement. The seams between the two pieces preferably fall on natural shadow lines in the surface ornamentation, such that the seams essentially become visually inconspicuous. The ends 102*a* and 104*a* of the seams may show along the inner rim 16, which in the example is relatively smooth. However, the rim is relatively thin and is in close proximity to the base of the fixture (not shown), and thus, the seam sections that cross the rim 16 will most likely not be noticed. The seam ends 102*b* and 104*b* fall on an outer rim that, like the inner rim, is smooth. The ends 102*b* and 104*b* may thus be visible, but they are generally not noticed because a viewer's eye is drawn instead to the surface ornamentation. Further, the ends of the seams are even less noticeable after the medallion painted.

To install the medallion 100, an installer or homeowner simply places the two medallion pieces 10 and 20 on either side of the associated fixture, and slidably joins the pieces until the alignment features mate. As discussed, the alignment features ensure that the two joined pieces are fully aligned. The installer then secures the joined medallion in place on the ceiling or wall with adhesive or other conventional fasteners, such as nails or screws. There is no need to remove the ceiling or wall fixture during installation, and a homeowner may therefore quickly and easily install the medallion, without the services of an electrician.

The foregoing has been a detailed description of a preferred embodiment of the invention. Various modifications and addition can be made without departing from its spirit and scope. For example, the two medallion pieces may be unequal in size. Also, the medallion may have various overall shapes, such as oval, rectangular, square, elliptical and so forth. Further, the two-piece medallion may be mounted on a wall around a wall fixture, such as a sconce. Accordingly, the forgoing descriptions is meant to be taken only by way of example and not to otherwise limit the scope of the invention.

What is claimed is:

1. A decorative medallion with ornamentation on a top surface for use with a fixture, the decorative medallion comprising:

a first piece having at a first end an overlapping member with an outline that follows a first ornamental feature of the surface ornamentation and a recessed receiving edge that is shaped in accordance with a first set of one or more alignment features, at a second end an underledge that is shaped in accordance with a second set of one or more alignment features; and a second piece having at a first end an underledge that is shaped to mate with the overlapping member of the First piece, the underledge shaped to mate with the first set of one or more alignment features, at a second end an overlapping member that follows a second ornamental feature of the surface ornamentation and a recessed receiving edge that is shaped to mate with the second set of one or more alignment features, whereby when the two pieces are assembled around a given fixture the first and second alignment features of the two pieces slidably mate to align the pieces, and the surface ornamentation continues across the pieces with first and second seams on the top surface following the first and second ornamental features, respectively.

2. The decorative medallion as set forth in claim 1, wherein the outline of the overlapping member follows a natural shadow line of the surface ornamentation.

3. The decorative medallion as set forth in claim 1, wherein the first set of alignment features includes a concave receiving portion and the second set of alignment features includes a corresponding protrusion, whereby the protrusion mates with the concave receiving portion and ensures alignment.

4. The decorative medallion as set forth in claim 1, wherein the first set of alignment features includes an extension of an inner rim and the second set of alignment features includes an undercut end of the inner rim, the two ends mating to ensures alignment.

5. The decorative medallion of claim 1 wherein the medallion is a ceiling medallion.

6. The decorative medallion of claim 1 wherein the medallion is a wall medallion.

7. The decorative medallion as set forth in claim 1, wherein the pieces are constructed of Architectural Foam.

8. The decorative medallion as set forth in claim 1, wherein the pieces are constructed of a bonded wood product.

9. The decorative medallion as set forth in claim 1, wherein the pieces are constructed of a plaster product.

10. A method of installing a decorative medallion having ornamentation on a top surface about a fixture on a wall or ceiling, the method comprising the steps of:

placing on one side of the fixture a first piece of a two-piece medallion, the first piece including a first end with an overlapping member that has an outline that follows a first ornamental feature of the surface ornamentation and a recessed receiving edge that is shaped in accordance with a first set of one or more alignment features, and a second end with an underledge that is shaped in accordance with a second set of one or more alignment features; and placing on an opposite side of the fixture a second piece of the two-piece medallion, the second piece including a fist end with an underledge that is shaped to mate with the recessed edge of the overlapping member of the first piece being a second end with an overlapping member that has an outline that follows a second ornamental feature of the surface ornamentation and a recessed receiving edge that is shaped to mate with the second set of one or more alignment features, sliding the first and second pieces relative to one another until the first and second sets of alignment features mate to align the pieces and the surface ornamentation continues across the two pieces, securing the mated pieces in place on the wall or ceiling.

11. The method of claim 10 wherein the first set of alignment features includes an extension of an inner rim and the second set of features includes an undercut end of the inner rim.

12. A two-piece decorative medallion with ornamentation on a top surface for installation on a surface of wall or ceiling that supports an installed fixture, the decorative medallion comprising:

a first piece with an inner dimension that corresponds to the dimension of the fixture at the surface of the wall or ceiling and a larger outer dimension, the first piece having at a first end an overlapping member with an outline that follows a first ornamental feature of the surface ornamentation and a recessed receiving edge that is shaped in accordance with a first set of one or more alignment features, at a second end an underledge that is shaped in accordance with a second set of one or more alignment features; and a second piece with inner and outer dimensions that correspond to the dimensions of the first piece, the second piece having at a first end an underledge that is shaped to mate with the overlapping member of the first piece, the underledge being shaped to mate with the first set of one or more alignment features, at a second end an overlapping member that follows a second ornamental feature of the surface ornamentation and a recessed receiving edge that is shaped to mate with the second set of one or more alignment features, whereby when the two pieces are assembled around the installed fixture the first and second alignment features of the two pieces slidably mate to align the pieces, and the surface ornamentation continues across the pieces with first and second seams on the top surface following the first and second ornamental features, respectively.

13. The decorative medallion as set forth in claim 12, wherein the outline of the overlapping member follows a natural shadow line of the surface ornamentation.

14. The decorative medallion as set forth in claim 12, wherein the first set of alignment features includes a concave receiving portion and the second set of alignment features includes a corresponding protrusion, whereby the protrusion mates with the concave receiving portion and ensures alignment.

15. The decorative medallion as set forth in claim 12, wherein the first set of alignment features includes an extension of an inner rim and the second set of alignment features includes an undercut end of the inner rim, the two ends mating to ensure alignment.

16. The decorative medallion as set forth in claim 12, wherein the pieces are constructed of Architectural Foam.

17. The decorative medallion as set forth in claim 12, wherein the pieces are constructed of a bonded wood product.

18. The decorative medallion as set forth in claim 12, wherein the pieces are constructed of a plaster product.

* * * * *